US005628175A

United States Patent [19]

Fischer

[11] Patent Number: 5,628,175

[45] Date of Patent: May 13, 1997

[54] HEATING APPARATUS FOR HEATING AN ADVANCING SYNTHETIC FILAMENT YARN

[75] Inventor: Martin Fischer, Solingen, Germany

[73] Assignee: Barmag AG, Remscheid, Germany

[21] Appl. No.: 493,655

[22] Filed: Jun. 22, 1995

[30] Foreign Application Priority Data

| | | | |
|---|---|---|---|
| Jun. 22, 1994 | [DE] | Germany | 44 21 841.9 |
| Nov. 12, 1994 | [DE] | Germany | 44 40 516.2 |

[51] Int. Cl.[6] ..... D01H 7/46; D01H 7/92

[52] U.S. Cl. ..... 57/290; 28/249; 57/282; 57/284

[58] Field of Search ..... 57/282, 284, 287, 57/288, 290; 28/240, 249, 258; 219/388

[56] References Cited

U.S. PATENT DOCUMENTS

| | | | |
|---|---|---|---|
| 2,990,670 | 7/1961 | Kingsbury | 57/34 |
| 3,559,965 | 2/1971 | Ishida | 219/358 |
| 4,567,721 | 2/1986 | Kuroda et al. | 57/284 |
| 4,809,494 | 3/1989 | Dammann | 57/291 |
| 5,138,829 | 8/1992 | Tanae et al. | 57/288 |
| 5,148,666 | 9/1992 | Bauer et al. | 57/290 |
| 5,313,776 | 5/1994 | Humbrecht et al. | 57/287 |
| 5,339,617 | 8/1994 | Dammann | 57/290 |
| 5,353,583 | 10/1994 | Tanae et al. | 57/288 |
| 5,404,705 | 4/1995 | Yanagihara et al. | 57/290 |
| 5,438,820 | 8/1995 | Nakahara et al. | 57/290 |

FOREIGN PATENT DOCUMENTS

| | | | |
|---|---|---|---|
| 0412429 | 2/1991 | European Pat. Off. . | |
| 412429 | 2/1991 | European Pat. Off. | 57/290 |
| 579866 | 10/1992 | European Pat. Off. . | |
| 0579866 | 1/1994 | European Pat. Off. . | |
| 2451415 | 10/1980 | France . | |
| 2534598 | 2/1977 | Germany . | |
| 3301510 | 8/1983 | Germany | 57/290 |
| 3801506 | 8/1988 | Germany . | |
| 39 26 316.9 | 8/1989 | Germany . | |
| 4020706 | 1/1992 | Germany . | |
| 4318674 | 12/1993 | Germany | 57/284 |
| 4318675 | 12/1993 | Germany | 57/284 |
| 6-184847 | 7/1994 | Japan | 57/284 |
| 890057 | 8/1959 | United Kingdom . | |
| 1126624 | 9/1968 | United Kingdom . | |
| 0406673 | 1/1991 | WIPO . | |
| WO94/29501 | 12/1994 | WIPO . | |

*Primary Examiner*—William Stryjewski
*Attorney, Agent, or Firm*—Bell, Seltzer, Park & Gibson, P.A.

[57] ABSTRACT

An elongate heater for heating an advancing synthetic filament yarn with reduced friction. The yarn is advanced in contact with a generally flat contact surface of the elongate heater, with yarn guides being arranged along the heater in spaced apart relationship, and so as to guide the yarn in a zigzagged path with a predetermined amplitude over the contact surface. The yarn guides may be constructed as cylinders, which extend perpendicularly to the contact surface of the heater.

20 Claims, 4 Drawing Sheets

HEATING APPARATUS FOR HEATING AN ADVANCING SYNTHETIC FILAMENT YARN

BACKGROUND OF THE INVENTION

The invention relates to an elongate heater for heating an advancing synthetic filament yarn and which is particularly adapted for use in a yarn false twist crimping machine.

An elongate yarn heater of this type is known from EP 0 406 673 and corresponding U.S. Pat. No. 5,339,617. This known configuration of the elongate heater is based on the recognition that the transferable amount of heat is dependent on the radius of curvature of the heater. Logically, this improved transfer of heat is due to the fact that the decrease in the radius of curvature is accompanied by an increase in contact forces of the yarn on the elongate heater, and that therefore a more intimate contact exists between the yarn and the heater.

An increased curvature, however, results in the disadvantage of a greater looping friction. In the known elongate heater, this disadvantage is alleviated, at least in part, in that the heater is permitted to be shortened.

It is an object of the present invention to provide a yarn heater of the described type which eliminates as much as possible the disadvantage of the looping friction, which is associated with every curved, elongate heater, so that the looping friction is practically negligible.

SUMMARY OF THE INVENTION

The above and other objects and advantages of the present invention are achieved by the provision of a yarn heating apparatus which comprises an elongate rail which extends in a longitudinal direction and which includes a generally flat yarn contact surface, and yarn guide means comprising a plurality of guide members mounted in a longitudinally spaced apart and interdigitally disposed arrangement along the length of the rail for engaging opposite sides of an advancing yarn and guiding the same along and in contact with the yarn contact surface in a laterally zigzagged path of travel.

The contact surface defines a contact surface line which is transverse to the longitudinal direction and which is preferably substantially straight. Also, the contact surface is preferably substantially straight in the longitudinal direction. However, the elongate heater may have a very small curvature, i.e., the radius of curvature is selected to be very large. It is in any event ≧10 meters.

Known from EP 0 412 429 and corresponding U.S. Pat. No. 5,148,666 is a false twist crimping machine, in which the yarn is advanced, without contacting, along an elongate heater in contact with yarn guides, which guide the yarn along a zigzagged path in a plane extending parallel to the heater and at a distance therefrom. In this process, the elongate heater and the yarn guides are heated to a temperature which is above the melting point of the polymer from which the synthetic filament yarns are made. It has been shown that guiding the yarn in this fashion permits a very good heat transfer to be realized that is largely independent of the size of the looping angle about the individual yarn guide and independent of the sum of the looping angles. From all previous experience, according to which there is a direct correlation between the size of the looping angle and the intensity of the heat transfer, this recognition was unexpected. According to the invention, this recognition is also transferred to a contact heater.

In doing so, it is possible, as aforesaid, to eliminate any significant curvature of the elongate heater in the direction of the advancing yarn. This is highly advantageous not only for the manufacture of elongate heaters, but also for the guidance of the yarn, since in this instance the heater does not cause an increase in the yarn tension.

The zigzagged path of the yarn is produced along the heater by means of yarn guides, preferably in the form of cylinders, which project substantially perpendicularly from the contact surface of the heater and have an axial spacing A and a lateral spacing or amplitude U. In a particular embodiment of the invention, heat transfer and frictional behavior of the yarn are optimized in that the amplitude U of the zigzagged path is 0.5 to 1.5%, preferably 0.9 to 1.4% of the axial spacing A, and that the diameter of the yarn guide cylinders is 8 to 25 mm, preferably 10 to 20 mm, in the region that is looped by the yarn.

The use of the elongate heater in a false twist crimping machine for crimping a synthetic filament yarn results primarily in the advantage that the propagation of the twist proceeding from the false twist unit is not impeded in the heating zone, since the looping about the yarn guides is very small. As a result of the invention, the heat transfer is produced no longer by intensifying the contact between the contact heating surface and the yarn, but as a result of removing any air jacket that impedes the heat transfer and more particularly of stripping effectively the air jacket that tends to form on the advancing yarn and the yarn guides. The specified dimensions are ideal for treating the yarn in particular in the lower denier range of ≦100 dtex. Of importance in this connection is the formula:

$$D = 0.0355 \times A/U \times \sqrt{T}$$

wherein:

D=Diameter of the yarn guides in the region of contact with the yarn, or average diameter of two successive contact surfaces;

U=Overlap of successive yarn guides or amplitudes of the zigzag path;

A=Axial spacing between two successive yarn guides; and

T=Denier, expressed in dtex, i.e., grams per 10,000 meters.

Irrespective of and in addition to the thermodynamic objective which is accomplished with the above-described yarn heater, and specifically with respect to the use of the yarn heater in a false twist crimping machine and, in particular, with the described dimensions, a further problem arises for such heaters, namely, that the temperature control on the yarn is of decisive importance for the quality of the crimped yarn. It is therefore necessary to define the yarn path in a very precise and accurately reproducible manner.

In accordance with the present invention, this is accomplished by the configuration of the yarn heater wherein the yarn guide members are in the form of cylinders mounted in cylindrical recesses in which extend in a direction perpendicular to the yarn contact surface. In this configuration, the use of circular-cylindrical yarn guides permits not only a very accurate and reproducible dimensioning of the yarn guides, but also the likewise important, accurate dimensioning of the recesses, which receive the yarn guides with a close tolerance, but without a press fit. It is possible to fit the yarn guides substantially free of play into these recesses. Thereafter, it is only necessary to secure them in the axial direction. Such a fastening, which is simple to remove and insert, allows worn or damaged yarn guides to be easily replaced.

In this connection, one should have the guarantee that the yarn can be inserted in a simple manner, without having to reach with one's hands into the heater heated to more than 200° C. It is therefore necessary to ensure that the yarn is tensioned, when inserting it, and forms a straight line. This problem is solved by providing a longitudinal groove in the rail, the bottom of which forms the contact surface.

For a better utilization of the heat, a yarn heater for at least two yarns is suitable. To achieve substantial savings in material and manufacturing expenditure, the rail may include a pair of longitudinally extending and parallel grooves so as to define a partition wall therebetween.

As already indicated, the configuration of the yarn guides, as described above, is significant primarily from a thermodynamic viewpoint in that a yarn insulating air jacket cannot develop or is stripped. This objective is accomplished, even when only few of the yarn guides reach this target in full, whereas others do so only in part.

The uniform heating of the yarn by the elongate heater is possible only, when the yarn heater and the heating surface formed on it receive an amount of heat which is adequate and constant over the length of the yarn heater. This is accomplished for the sake of simplicity by an elongate, bar-shaped resistance heater. Yet, there exists the problem that these electric heating rods need to have on the one hand an intimate, highly heat-conductive contact with the elongate heater, whereas on the other hand they should also be easily exchangeable. This is achieved by providing the underside of the rail with longitudinal grooves which accommodate resistance heating elements, and with the heating elements being secured to the rail with a covering clamping member.

The yarn heating apparatus described in EP 412 429 consists of two elongate heating segments, which are inclined relative to one another in roof shape, so that the two yarn heating segments form with each other an obtuse angle. Also this positioning needs to be carried out with great accuracy, especially when it is intended to be easily adjustable and reproducible. To achieve this objective, there is provided a mounting support for the rail, which is in the form of a U-shaped section so as to provide side walls which surround the yarn heating segments. The U-shaped profile has simultaneously the effect of keeping the temperature uniform over the length of the heating apparatus.

In the crimping of synthetic yarns by the false twist texturing process, it is especially problematic to process low-denier yarns, especially deniers of ≦100 dtex. Such yarns are made, for example, of polyamide (nylon) and used for ladies' hosiery. Their processing is problematic, in particular when the elongate heater is heated to a temperature which is above the melting point of the polymer, for example, polyamide. Such high temperatures are advantageous not only for an efficient heat transfer and thus a reduction of the heater length, but these high temperatures also lead to the selfcleaning of the heater to a certain degree, so that the cleaning intervals can be lengthened. On the other hand, this high temperature leads to the melting of the yarn when being overheated. This overheating can be avoided with the present invention.

BRIEF DESCRIPTION OF THE DRAWINGS

Some of the objects and advantages of the present invention having been stated, others will appear as the description proceeds, when considered together with the accompanying drawings, in which.

DETAILED DESCRIPTION OF THE PREFERRED EMBODIMENTS

Figure 1A:
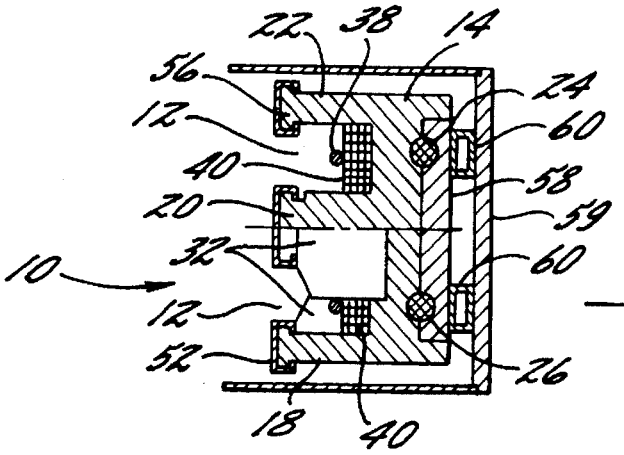
FIG. 1A is a cross sectional view of the heating apparatus illustrated in FIG. 1.

A yarn heating apparatus which embodies the features of the present invention is illustrated generally at 10 in the drawings. As indicated above, the heating apparatus is particularly adapted for use in a yarn false twist crimping machine, which conventionally comprises yarn heating means, yarn cooling means, yarn false twisting means, and means for advancing a yarn serially through these members. Also, a winder is provided for winding the processed yarn into a package. A false twist crimping machine of this type is illustrated in U.S. Pat. Nos. 5,148,666 and 4,809,494, the disclosures of which are expressly incorporated herein by reference.

Figure 1:
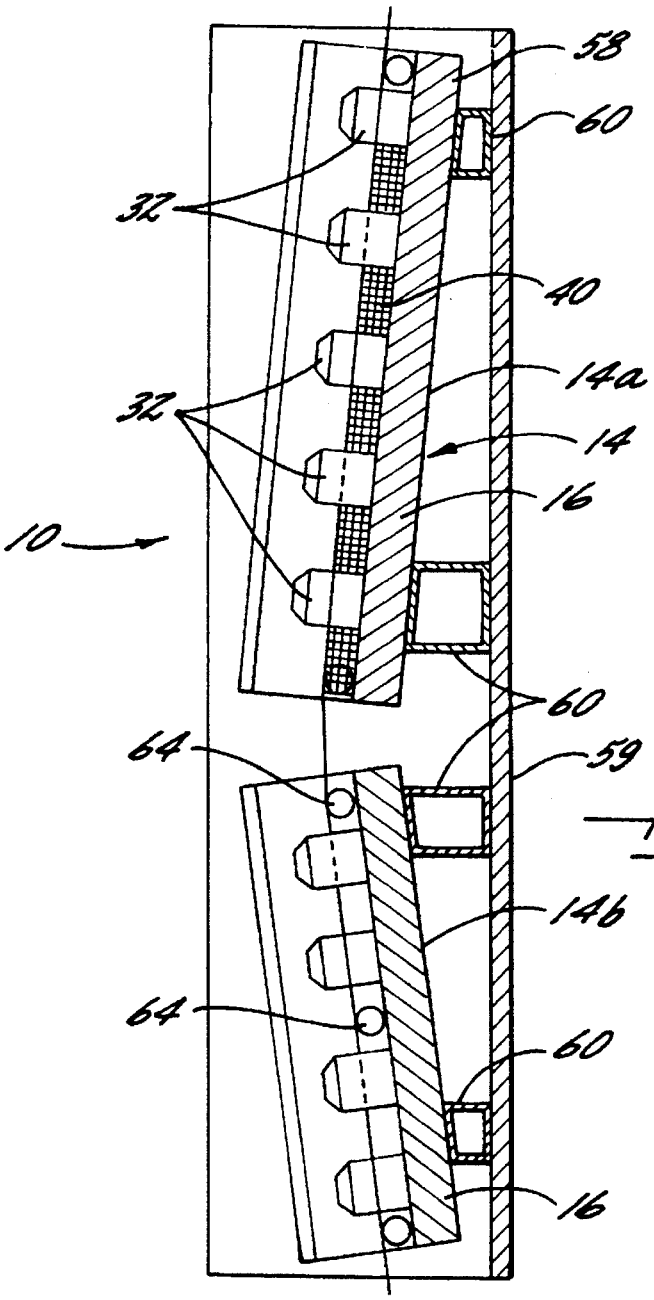
FIG. 1 is a sectional side elevation and schematic view of a yarn heating apparatus which embodies the present invention.

The heating apparatus 10, as shown in FIGS. 1 and 1A, consists of an elongate body or rail 14 which consists of two rail segments 14*a* and 14*b*, one following the other in the direction of the advancing yarn. Each segment is provided with two longitudinal grooves 12 and is composed of a material which is heat resistant and nonscaling, such as for example a copper alloy, and which is resistant to temperatures in a range above 450° C. over long periods of time without undergoing noteworthy changes. Each rail segment 14*a* and 14*b* includes a substantially flat base portion 16, which is heated in the manner described below. Connected with the base portion are three walls 18, 20, 22, between which the longitudinal grooves 12 are located. However, it is also possible to provide base portion 16 with two or more than three upwardly directed walls, between which correspondingly less or more grooves extend.

As illustrated, the rail 14 has a cross section similar to an extruded profile, in which the base portion 16 and walls 18, 20, 22 are made of one piece. Alternatively, the center wall 20 and the outer walls 18 and 22 may be separate pieces which are bolted to base portion 16.

Inserted in walls 18, 20, 22 at regular intervals A (FIG. 3) from one another are recesses or bores 28 having substantially the same depth, with recesses 28 arranged in center wall 20 being offset by a spacing A from recesses 28 in side walls 18 and 22. The recesses have a circular-cylindrical shape. Each recess 28 is intersected by the axial grooves 12 along a secant line, so that walls 18, 20, 22 exhibit slots 30, i.e. rectangular openings, facing the axial groove 12. In the illustrated embodiment, the recesses extend perpendicularly to the groove bottom, and their depth generally corresponds to the height of walls 18, 22, in which they are accommodated.

Each recess 28 accommodates a yarn guide 32, the cross sectional shape of which corresponds to the cross section of the recess both in size and shape, and which, for purposes of maintaining close tolerances, rests firmly, but with a play, against the wall of the recess. In the region of each slot 30, a portion of each yarn guide 32 extends into the axial groove 12 such that, on opposite sides of each groove 12, successively arranged yarn guides 32 extend by a certain dimension, for example 0.1 to 1 mm, beyond a central plane 50 extending parallel to walls 18, 20, 22. Otherwise, the width of each slot 30 is smaller than the largest cross sectional dimension, i.e., than the diameter of yarn guides 32, so that they are unable to slide out of recesses 28.

In the illustrated embodiments, both recesses 28 and yarn guides 32 have a circular-cylindrical cross section. Other angular as well as rounded shapes, such as ellipses, diamonds, triangles, etc. are possible. The embodiment of FIGS. 1, 2 has a fit between recesses 28 and yarn guides 32, which is kept within accordingly close tolerances. As a result, separate fastening means to secure yarn guides 32 against axial and radial displacement is not needed, thereby eliminating special expenses, which would otherwise result from the use of fastening means. Clearance fits may also be selected, which on the one hand, are narrow enough, so that the yarn guides rest unmovably in their recesses. On the other hand, however, the clearance fits may be wide enough, so as to make it easy to pull out the yarn guides from their recesses and replace same.

For purposes of securing the yarn guides in the axial direction, sheet metal caps 52 are used. To this end, side walls 18, 20, 22 are provided on their upper edge with retaining grooves 54 or a head 56, which is wider than the respective wall. In cross sectional view, the sheet metal caps 52 have a cup-shaped profile, so that in the case of center wall 20 they extend into retaining grooves 54, and in the case of side walls 18, 22 they embrace the wall head 56. Otherwise, the sheet metal caps are constructed as elongate profiles, the length of which corresponds to that of the yarn heater. The thickness of wall heads 56 and the position of retaining grooves 54, respectively, and the corresponding dimensioning of the sheet metal caps are such that the sheet metal caps secure the yarn guides in the axial direction.

The yarn guides 32 consist of materials commonly used for this purpose, such as silicon, titanium, or aluminum oxides, or of nitrided or chromium plated steel, or the like.

Figure 2A:
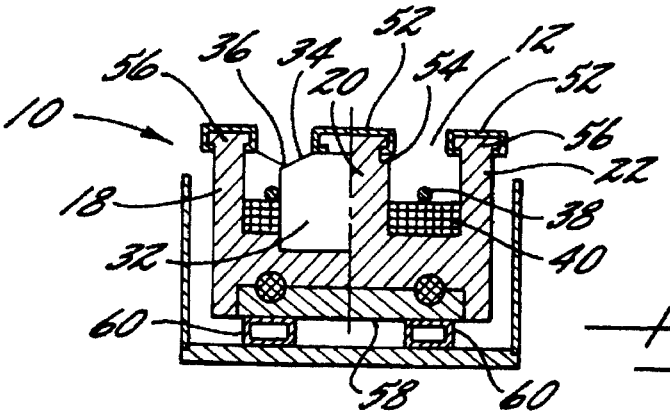
FIG. 2A is a cross sectional view of the heating apparatus taken along the section line 2A—2A illustrated in FIG. 2.
Figure 3:
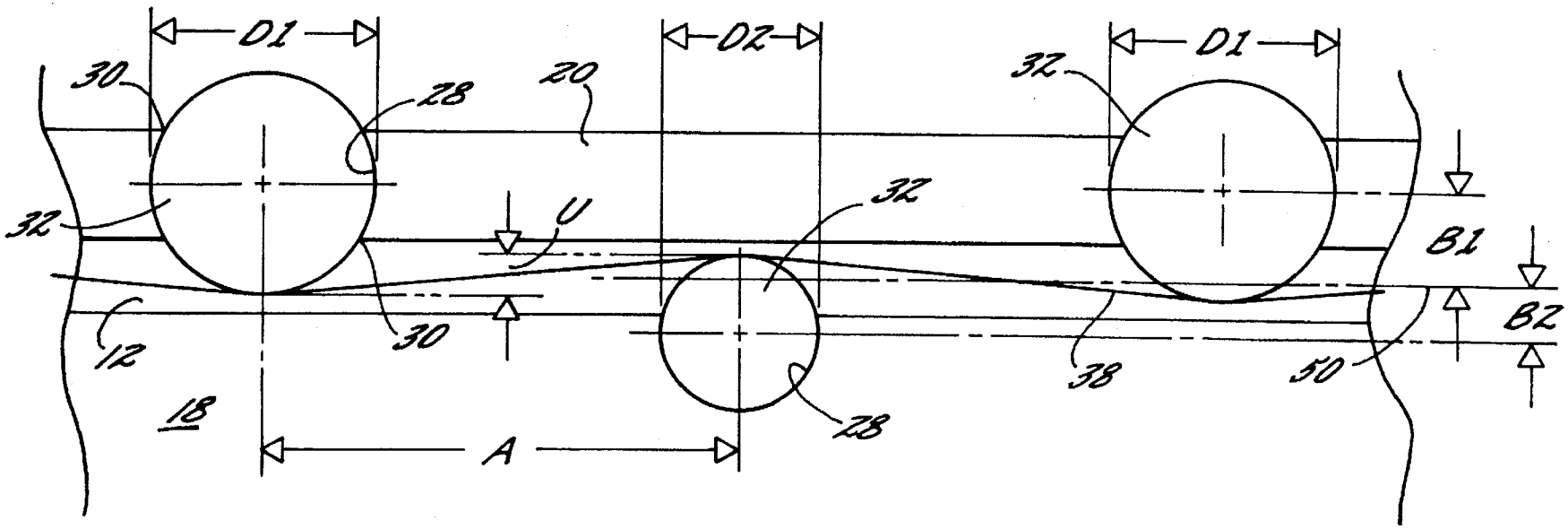
FIG. 3 is a schematic view of three successive yarn guides of the heating apparatus and illustrating their dimensions.

Preferably, in the region, in which they project from recess slot 30, the yarn guides 32 are conically beveled on their ends facing away from the base portion 16, as is indicated at 34. As a result, the yarn guides 32 successively arranged in opposite walls 18 and 20, or 22 and 20 form in the cross sectional direction of the heating apparatus 10 respectively a V-shaped groove 36 (FIG. 2A), which permits a yarn 38 to be guided in its stretched condition between yarn guides 32, without any special auxiliary measures or arrangements between successive yarn guides 32, in a movement substantially perpendicular with respect to base 16. There, the yarn resting against the contact surfaces forms then a zigzagged yarn path as seen in FIG. 3.

As noted above, the embodiment of the heating apparatus 10 as illustrated in FIG. 1 consists of two rail segments **14*a* and 14*b*, one following the other in direction of the advancing yarn. While these segments differ in length, they have otherwise the same cross sectional shape. The purpose of such a bipartite arrangement may lie in the different heating of heating apparatus 10 over different length segments, so as to treat yarn 38 in a heat profile which satisfies its properties. It is also possible to use more than the two illustrated segments. In this arrangement, it is especially important that the angle which the two yarn heating segments form with one another, is identically adjusted at each processing station of the false twist crimping machine, so as to produce yarns of the same quality on all processing stations. To mount the two yarn heating segments a mounting support 59 is used. The latter is a rail which has the length of the two heater segments. The mounting support has a U-shaped cross section. The yarn heating segments are attached to the bottom of the mounting support by means of spacers 60. The dimensioning of the spacers and their position relative to the heating segment allow to define the inclination of the heating segment with respect to the straight mounting support 59. In the illustrated arrangement, the two heating segments are inclined oppositely, and form with each other an obtuse angle. Thus, mounting support 59 is used on the one hand for a specific fastening of the two heating segments. Since mounting support 59 has a U-shaped profile, it embraces, however, also the two heating segments. Therefore, the mounting support 59** also serves to make the temperature constant over the length and width of the heating segments.

Moreover, the heating apparatus 10 is accommodated in an insulated box (not shown), in which it is embedded in a thermally insulated material, for example, fiber glass. The insulated box may be provided with a door (not shown), which permits it to be opened, so as to provide access to heating apparatus 10, and to thread the yarn.

As can be noted from all embodiments, the peripheral surfaces, on which the yarn guides 32 contact the yarn, have a relatively large diameter. Contrary thereto, the zigzag line, along which the yarn advances as a result of the overlap U of successive yarn guides, has a relatively small amplitude with a relatively large spacing A between two neighboring yarn guides. This allows the looping angle, at which the yarn loops about the yarn guides or the contact surfaces formed on same, to be also small when summed. As a result, the twist of the yarn in the false twist zone of a false twist crimping machine is not impeded. Nonetheless, due to the large diameter, the contact length of the yarn is sufficient, so as to allow a low-denier yarn (for example 20 dtex) to turn once about its axis when passing over a yarn guide, and to thereby completely strip off the air jacket, which surrounds the yarn and obstructs the heat transfer.

A higher-denier yarn needs to advance over two or three yarn guides, so as to perform a complete turn. However, since the number of the yarn guides distributed over the length of the yarn heater, and in particular the number of the yarn guides distributed over several heater segments, amounts to at least twice as much, it is ensured that, as the yarn advances through the heating device, the air jacket surrounding the yarn is totally stripped off twice in any event. As shown in FIG. 3, yarn guides are used with different diameters D1 and D2. The yarn guides are arranged at equal spacings A. The yarn path forms a zigzag path, and the amplitude of this zigzag path is indicated at U. This dimension U is identical with the overlap of two successive yarn guides, which results from the fact that the successively arranged yarn guides extend each beyond the central plane 50.

When within the scope of the present application reference is made to the diameter of the yarn guides or contact surfaces, same is understood to be the mean diameter of two yarn guides, one following the other in the path of the yarn. As can be noted from FIG. 3, the overlap U results from the formula:

$$(D1/2-B1)+(D2/2-B2).$$

In the embodiment of FIGS. 1 and 1A, the rail 14 is provided on its side facing away from axial groove 12 with two grooves, which extend substantially below respective ones of the yarn guide grooves 12. Inserted into these grooves are heating elements 24 and 26. The heating elements are clamped in place by a mounting support 58, which extends over the entire length of the yarn heater. To this end, the mounting support is likewise provided with grooves, which surround heating elements 24, 26. By detaching the mounting support 58, heating elements 24, 26 can be easily exchanged.

Figure 2:
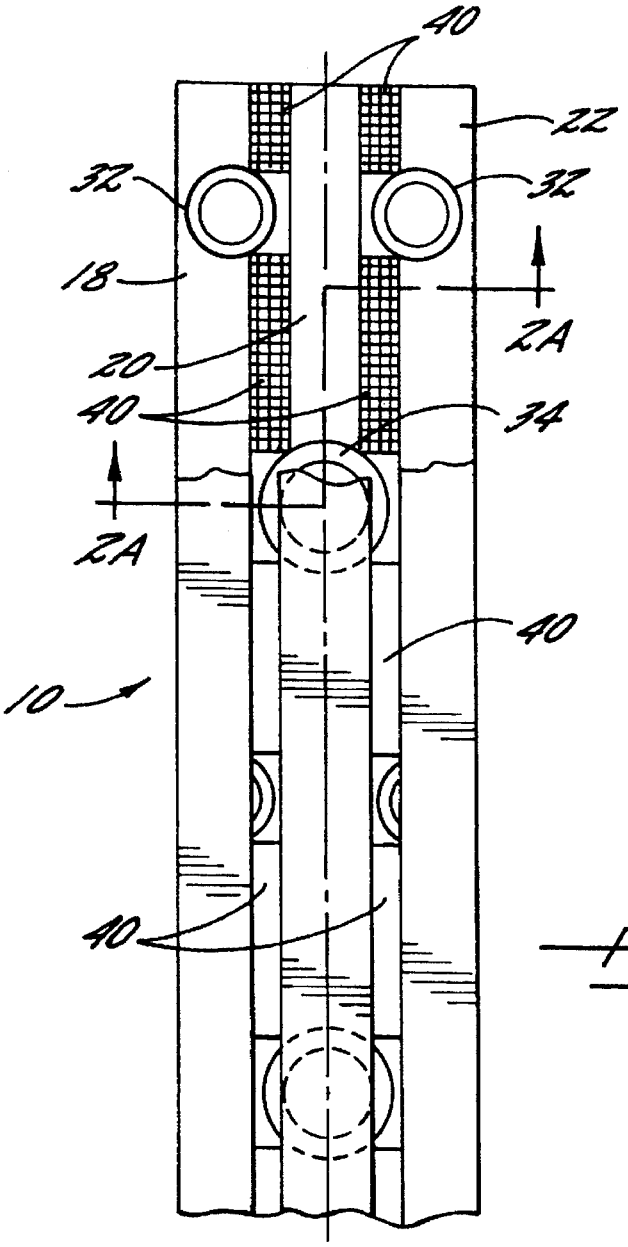
FIG. 2 is a fragmentary top view of a heating apparatus in accordance with the invention, and which includes a pair of grooves.

Up to this point, the two segments 14*a* and 14*b* of the heater shown in FIG. 1 are of identical construction. Beyond that, the first segment 14*a* of the heater has the following characteristic features, which are shown in FIG. 2:

Inserted into the axial grooves 12 are contact blocks 40. These contact blocks 40 are rectangular parallelepipeds, which fit exactly into the axial groove 12 and into the free space between adjacent guides 32. The height of the parallelepipeds is such that they fill the groove only in part. Since the bottom of axial groove 12 is straight, and the parallelepipeds have all the same size, the upper sides of contact blocks 40 being directed toward the opening of axial groove 12 are aligned in one flat surface. The yarn is guided over this flat surface and deflected by the successively arranged yarn guides 32 so as to form a zigzagged path as described above. In the illustrated embodiment, the second segment 14*b* of the heater has no such contact blocks. In this second segment, the yarn advances along the groove bottom without contacting same. Instead, spacers 64 are provided which are distributed over the length of this second segment. The yarn path is such that the yarn advances, first in contact with contact blocks 40 of the first heater segment 14*a*, and subsequently through the second heater segment 14*b*. Both heater segments may be heated to temperatures which are above the melting point to the yarn. In the instance of the first heater segment 14*a*, in which the yarn advances in contact with contact blocks 40, this is all the more unexpected, inasmuch as it permits to also use temperatures, at which a self-cleaning effect occurs by burning, i.e. oxidizing residues.

It is also possible to operate the contact heater at a temperature that is within the range of the target temperature, to which the yarn is to be heated. The two-part heating apparatus of FIG. 1 is shown only as an example. It is likewise possible to treat the yarn only by one contact heater, the temperatures of which can again be within the range of the target temperature or within the range above the melting point. The embodiment of FIG. 1 permits the noncontacting segment of the heater to be also arranged in the yarn path preceding the contact heater segment.

The contact blocks 40 may be clamped into the groove by means of a press fit. Alternatively, they may be secured in position by lateral clamping screws. Likewise, it is possible to divide the elongate heater in the region of a groove wall and to join same by screws so tightly that the contact blocks are clamped. The contact blocks 40 may entirely fill the spacing between the yarn guides. However, they may also extend only over a portion of this spacing, so that the yarn advances in the remaining portion without contacting and is heated by radiation and convection. It is likewise possible to have the ends of the contact blocks fit around the circumference of the yarn guides so closely that the yarn is always in contact with a heated surface, i.e., it is guided so as to alternatingly contact the contact block and the following yarn guide.

Figure 4A:
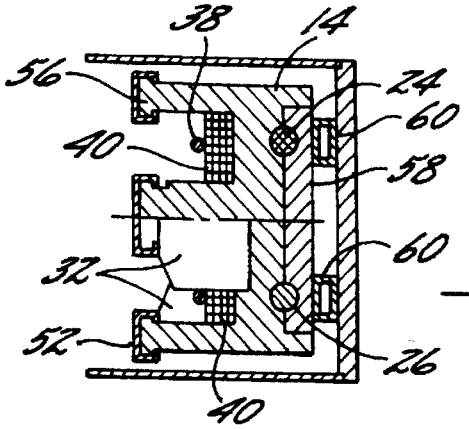
FIG. 4A is a cross-sectional view of the apparatus shown in FIG. 4.
Figure 4:
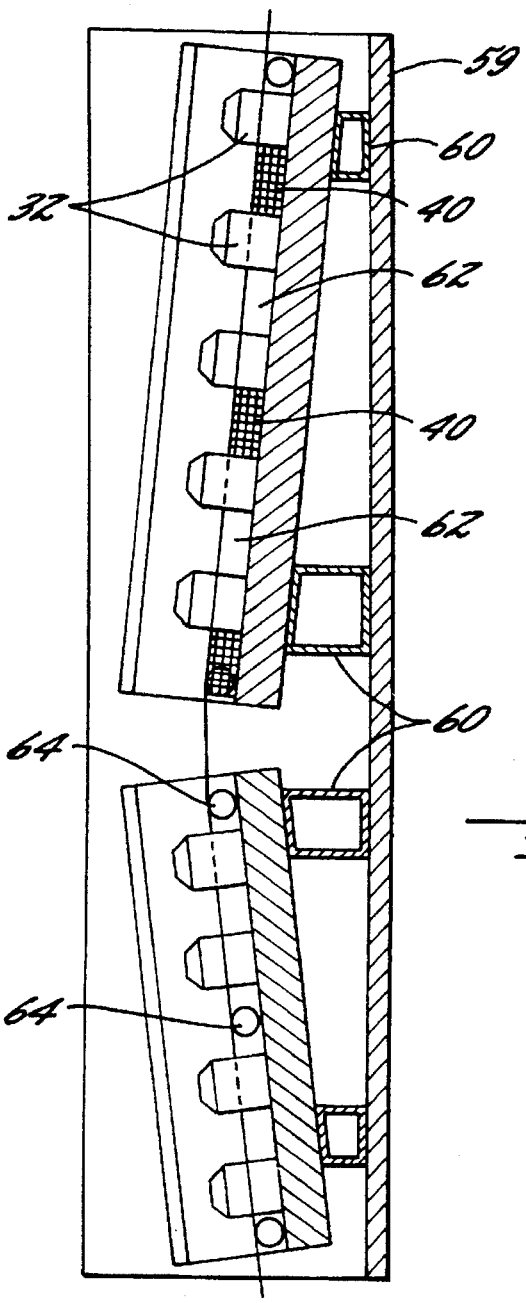
FIG. 4 illustrates an embodiment of the heating apparatus with contact zones alternating with noncontact zones.

Shown in FIG. 4 is a heating apparatus corresponding basically to that of FIG. 1, so that the description thereof is incorporated by reference. In this embodiment, however, the contact blocks 40, along which the yarn advances in contact with a heated surface, alternate with noncontact zones 62, in which the yarn advances at a distance from the heated surface. This is realized in that either between two adjacent yarn guides 32, contact blocks 40 are inserted into the groove, thus resulting in contact zones, or they are left out, thus forming noncontacting zones.

The thickness of the contact blocks is limited. However, it preferably amounts to more than 1/10 of the entire groove height, and is in any event smaller than 1/2, preferably smaller than 1/5 of the overall groove height.

That which is claimed is:

1. An apparatus for heating an advancing yarn, comprising an elongate rail which extends in a longitudinal direction and which includes a generally flat yarn contact surface, and yarn guide means comprising a plurality of guide members mounted in a longitudinally spaced apart and interdigitally disposed arrangement along the length of said rail for engaging opposite sides of an advancing yarn and guiding the advancing yarn along and in contact with the yarn contact surface in a laterally zigzagged path of travel.

2. The yarn heating apparatus as defined in claim 1 wherein said contact surface defines a contact surface line which is transverse to the longitudinal direction and is substantially straight.

3. The yarn heating apparatus as defined in claim 2 wherein said contact surface is substantially straight in the longitudinal direction.

4. The yarn heating apparatus as defined in claim 3 wherein said contact surface is discontinuous along the longitudinal length of said rail and so as to define a plurality of contact zones and a plurality of non-contact zones along the longitudinal length of said rail.

5. The yarn heating apparatus as defined in claim 1 wherein said guide members each include a cylindrical surface portion and each guide member is mounted to said rail so that the cylindrical surface portion defines an axis which extends in a direction perpendicular to said yarn contact surface.

6. The yarn heating apparatus as defined in claim 5 wherein the laterally zigzagged path of travel has an amplitude (U) which is between about 0.6 and about 1.5% of the spacing (A) between the guide members, and said cylindrical surface portion is positioned in the region of contact with the advancing yarn and has a diameter of between about 8 and about 25 mm.

7. The yarn heating apparatus as defined in claim 5 wherein said rail includes at least one longitudinal groove, the bottom of which defines said contact surface.

8. The yarn heating apparatus as defined in claim 7 wherein said one longitudinal groove includes opposite side walls and defines a central plane located centrally between said side walls, and wherein said side walls include cylindrical recesses into which said cylindrical surface portions of said guide members are received such that the cylindrical surface portions project laterally into said groove beyond said central plane.

9. The yarn heating apparatus as defined in claim 8 wherein said cylindrical surface portions of said guide members each have a first peripheral portion which is within said groove and a second peripheral portion which is within the associated recess, and wherein said first peripheral portion is smaller than said second peripheral portion.

10. The yarn heating apparatus as defined in claim 9 wherein said guide members each further include a frustoconical surface at the end thereof spaced from said contact surface.

11. The yarn heating apparatus as defined in claim 8 wherein each of the side walls mounts a sheet metal cap which extends in the longitudinal direction of the heater and engages the ends of the yarn guide members positioned in such side wall and covers at least a portion of the ends which project beyond such side wall.

12. The yarn heating apparatus as defined in claim 8 wherein said rail includes an underside which is provided with at least one longitudinal groove which accommodates a resistance heating element, and wherein the resistance heating element is secured to the rail and covered by a clamping member.

13. The yarn heating apparatus as defined in claim 8 wherein said rail includes a plurality of metal blocks disposed in said groove between the yarn guide members so as to define said yarn contact surface, said blocks being constructed as parallelepipeds and having a thickness smaller than the groove depth.

14. An apparatus for concurrently heating a pair of advancing yarns comprising an elongate rail which extends in a longitudinal direction, said rail including a pair of longitudinally extending and parallel grooves formed therein so as to define a partition wall positioned between said grooves and two outer side walls, and with said grooves each including a generally flat yarn contact surface along at least a part of the longitudinal length thereof, and a plurality of yarn guide members mounted in a longitudinally spaced apart and interdigitally disposed arrangement along the length of each of said grooves for engaging opposite sides of an advancing yarn and guiding the advancing yarn along and in contact with the yarn contact surface in a laterally zigzagged path of travel.

15. The yarn heating apparatus as defined in claim 14 wherein said yarn guide members each include a cylindrical surface portion and said partition wall and said side walls each include cylindrical recesses into which said cylindrical surface portions of said yarn guide members are received such that the cylindrical surface portions project laterally into said grooves.

16. The yarn heating apparatus as defined in claim 15 wherein said partition wall has a lateral dimension which is less than the diameter and greater than the radius of the cylindrical surface portions of said yarn guide members positioned therein such that the cylindrical surface portions of said yarn guide members positioned in said partition wall extend laterally into each of said grooves.

17. The yarn heating apparatus as defined in claim 16 wherein the diameter of the cylindrical surface portions of said yarn guide members positioned in the partition wall is greater than the diameter of the cylindrical surface portions of said yarn guide members positioned in the side walls.

18. An apparatus for heating an advancing yarn, comprising an elongate rail which extends in a longitudinal direction and which comprises a first longitudinal segment which includes a generally flat yarn contact surface and a second longitudinal segment which is characterized by the absence of a yarn contact surface, and yarn guide means comprising a plurality of guide members mounted in a longitudinally spaced apart and interdigitally disposed arrangement along the length of said rail for engaging opposite sides of an advancing yarn and guiding the advancing yarn along and in contact with the yarn contact surface in a laterally zigzagged path of travel during passage through said first longitudinal segment, and for engaging opposite sides of the advancing yarn and guiding the advancing yarn in a laterally zigzagged path of travel which is adjacent but spaced from the surface of the rail during passage through said second longitudinal segment.

19. The yarn heating apparatus as defined in claim 18 wherein said first and second longitudinal segments are disposed at an obtuse angle with respect to each other.

20. A yarn false twist crimping machine for processing synthetic yarn and comprising yarn heating means, yarn cooling means, yarn false twisting means, means for advancing a yarn serially through said yarn heating means, said yarn cooling means, and said yarn false twisting means, and means for winding the processed yarn into a package, said yarn heating means comprising an elongate rail which extends in a longitudinal direction and which includes a generally flat yarn contact surface, and yarn guide means comprising a plurality of guide members mounted in a longitudinally spaced apart and interdigitally disposed arrangement along the length of said rail for engaging opposite sides of an advancing yarn and guiding the advancing yarn along and in contact with the yarn contact surface in a laterally zigzagged path of travel.

* * * * *